United States Patent [19]

Hawthorne et al.

[11] 4,036,529

[45] July 19, 1977

[54] SUPPORT SYSTEM FOR A UNITIZED PAIR OF AUGER CONVEYORS

[75] Inventors: Arthur L. Hawthorne, St. Clairsville, Ohio; David R. Hazen, McMurray, Pa.

[73] Assignee: Continental Oil Company, Ponca City, Okla.

[21] Appl. No.: 574,135

[22] Filed: May 2, 1975

[51] Int. Cl.[2] ..... E21C 27/22

[52] U.S. Cl. ..... 299/19; 175/76; 175/91; 175/323; 175/325; 299/57

[58] Field of Search ..... 299/55, 56, 57, 18, 299/19; 175/91, 24, 73, 76, 394, 323, 325; 198/9, 36, 213

[56] References Cited

U.S. PATENT DOCUMENTS

| | | | |
|---|---|---|---|
| 837,490 | 12/1906 | Nelson | 175/394 |
| 2,942,714 | 6/1960 | Glaser | 198/213 X |
| 3,083,955 | 4/1963 | Compton | 299/56 |
| 3,746,110 | 7/1973 | Young et al. | 299/56 |

*Primary Examiner*—Ernest R. Purser
*Assistant Examiner*—William F. Pate, III
*Attorney, Agent, or Firm*—William J. Miller

[57] ABSTRACT

In an auger mining system which forms an opening in the earth comprising a pair of axially aligned cylindrical holes and wherein the opening has a bottom, the system has a pair of side-by-side conveyors. Each auger conveyor has a shaft and a flight around the shaft which shafts are journaled through bearings at each end to a spacing member and where the spacing members are rigidly tied to each other by a longitudinal member having an underside. A supporting apparatus including a skid is attached to the auger pair and extending to the bottom of the opening. The skid may be attached either to the underside of the longitudinal member or to each of the bearings. If the skids are attached to the bearings, then skids which are on adjacent bearings of mating auger pairs are arcuately staggered to permit side-by-side positioning of the skids.

5 Claims, 11 Drawing Figures

FIGURE 1-A

SUPPORT SYSTEM FOR A UNITIZED PAIR OF AUGER CONVEYORS

RELATED APPLICATIONS

An application entitled "Wire Communications Channel for a Pair of Unitized Augers" by Hawthorne and Hazen, Ser. No. 574,186, filed May 2, 1975 now U.S. Pat. No. 4,021,076 and an application entitled "Apparatus for Unitizing a Pair of Augers" by Hawthorne and Hazen, Ser. No. 544,071, filed May 2, 1975 now U.S. Pat. No. 4,015,071, are related to this application.

BRIEF DESCRIPTION OF THE PRIOR ART

One method for removing minerals, such as coal, from a horizontal seam is to utilize a pair of side-by-side cutting heads connected axially to a pair of augers which are used to convey the material once cut out of the hole. One or more pairs of augers may be utilized depending upon the depth of the hole. Each auger is powered by a machine which applies axial as well as rotational forces to the augers to both force the augers and the cutting heads into the seam being mined and to rotate the cutting heads breaking away the material wherein the augers will then convey the material away from the hole. On occasions, in order to prevent the pair of augers from being forced apart, spacers have been applied, for example, after each three or four sets of augers, to tie the auger pairs together.

When side-by-side augers are utilized, the vertical face between the two side-by-side mined holes tends to break away, leaving a cusp at the bottom between the drilled holes. In prior art systems, for example, the patent to H. D. Letts, U.S. Pat. No. 3,036,821, bearings were attached between each of the augers and to the bearings were mounted a plurality of extending legs referred to as a spider. The spider tended to support the auger conveyor away from the ground so that the actual auger flight would not rub the ground as it rotated, thus reducing the rotational horsepower of this system. The system of Letts, however, cannot be operated in a side-by-side boring system such as above described since the spiders will not be able to afford support in the sidewalls between the two holes since these two sidewalls break away, removing any support for the spider. U.S. Pat. No. Re 24,503 to C. E. Compton, which was originally U.S. Pat. No. 2,751,203, also illustrates a spider-type support system for an auger mining system.

BRIEF DESCRIPTION OF THE INVENTION

One of the related applications titled "Apparatus for Unitizing a Pair of Augers" describes a method for coupling two auger pairs which are normally positioned side-by-side so that the auger pair can be handled as a single unit. The unitized pair has several advantages over the individual side-by-side augers. First, the unitized pair requires much less time to handle, either removing or inserting, during the mining operation. Second, each unitized auger pair requires only a single pin to join one pair with the preceding pair. The pin will also be facing upward, thereby providing an easy method for removal. Furthermore, since the pin does not rotate, no locking system need be used to retain the pin during the augering operation The method, however, has one distinct advantage over prior art systems in that when the auger pairs are unitized as a single assembly, a means can be provided for supporting the auger pair off the ground in spite of the fact that the center supporting wall between the drilled holes no longer exists sufficiently to support the prior art spider-type support systems.

Normally when side-by-side holes are drilled by a pair of side-by-side suger cutting heads, a cusp is left between the twin holes. This cusp is a raised portion that is not cut away by the cutting heads. As previously discussed, when the augers are made into a unitized section, two side-by-side augers have bearings mounted on each end of the shafts between the flights extending around the shafts. Spacer bars are attached to these bearings, and a longitudinal member is attached to the spacer bars between the flights of the side-by-side auger pairs. This longitudinal member provides a means for mounting a support system which can be attached to the underside of the longitudinal member and ride on the cusp which is formed during the removal operation. A short shoe-type support can also be attached vertically or nearly vertically from the bearing to the bottom of thehole being formed during the mining operaion. The shoe must have a length not exceeding the width of both bearing members on mating auger pairs. In order to permit the side-by-side placement of shoes on adjacent auger pairs, one pair of short shoes should be axially rotated so that the shoes will fit side-by-side when the auger pairs are mated.

BRIEF DESCRIPTION OF THE FIGURES.

FIG. 1*a* is a cross-sectional view taken through 1*a*—*1a* of FIG. 1;

DETAILED DESCRIPTION OF THE INVENTION

Similar numbers will be used throughout this specification for similar elements.

Figure 1:
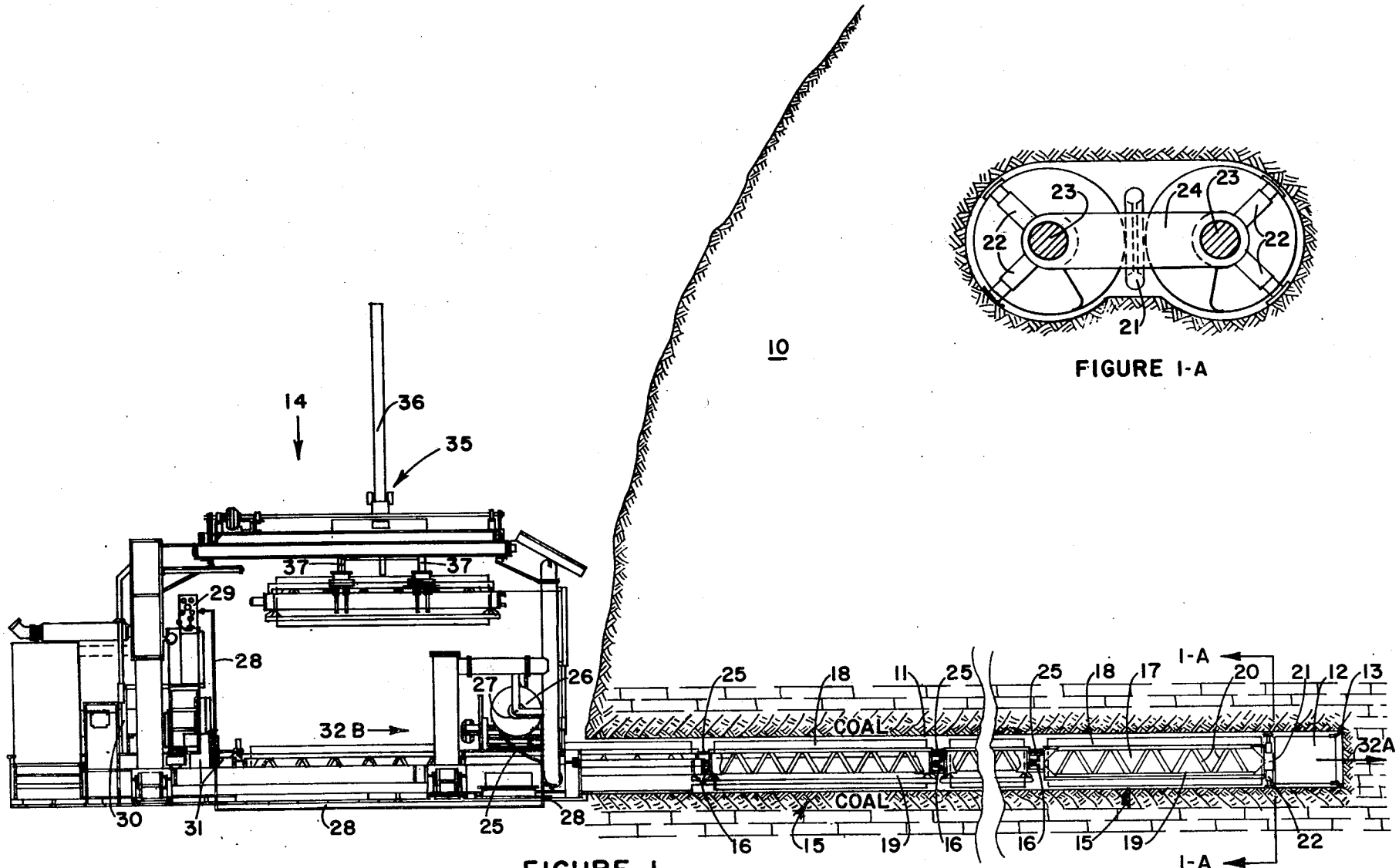
FIG. 1 is a cross-sectional view of a hillside illustrating the augering machine outside the hillside during a removal operation.

Referring to FIG. 1, a hillisde generally referred to by the number 10 has a mined-out portion 11 being cut be a pair of boring heads or cutters 12 having teeth 13. An augering machine generally referred to by the arrow 14 has a plurality of unitized augering sections 15 attached to its power output source. Each of the unitized sections illustrated in FIG. 1 has one auger conveyor removed in order to illustrate the horizontal support system in better detail. The horizontal support system will be described specifically in subsequent figures.

A joining coupling 16 is attached to a spacer bar (not shown) in FIG. 1. The spacer bar is attached to a longitudinal member 17. Longitudinal member 17 may consist of a top channel 18 and a bottom channel 19 connected by a plurality of diagonal braces 20 to form a truss.

A directional control apparatus 21 is mounted between the last unitized section 15 and boring or cutting head 12 and may include a jacking means 22, for example, to force the cutter head 12 upwardly or downwardly and may also include sensing equipment (not shown) to determine the center of the coal seam, the direction the hole is being drilled, and other pertinent information to the drilling of a long horizontal hole. The directional information and coal seam thickness information do not form a part of this invention and will not be further discussed in this application. Such equipment is well known, however. The electrical connections to the directional control apparatus contained in the vicinity of cutter head 12 are coupled through wires 25 to a reel 26. Brushes 27 on reel 26 convey the information through wires 26 to a control system 29 on augering apparatus 14. Augering apparatus 14 generally includes a power source referred to by an arrow 30 which is coupled at 31 to the unitized auger sections. It is obvious, of course, that each of the individual auger is driven through a gear box to power source 30. It is also obvious that only rotational forces develop to the drive system but also axial pressure is developed along the length of the unitized sections by power system 30. Thus, as boring head 12 cuts into hillside 10 in the direction of arrow 32*a,* the unitized augers will move in the direction of arrow 32*b.*

Augering machine 14 also includes a crane apparatus 35 which has a hydraulic lift 36 for attaching through arms 37 to unitized auger section 15. In the ordinary course of operation, the crane or lift 35 will pick up a unitized section setting beside the auger machine, lift it up, and lower it into the machine bed. Such a machine is currently being manufactured by the Salem Tool Company located in Salem, Ohio, and is readily available.

FIG. 1*a* shows in more detail the directional control apparatus and essentially consists of jacks 22 which are attached to shafts 23 through a bearing assembly 24. Bearing assembly 24 may also contain sensing equipment 21 which will determine as previously mentioned the coal thickness and other useful information.

Figure 3:
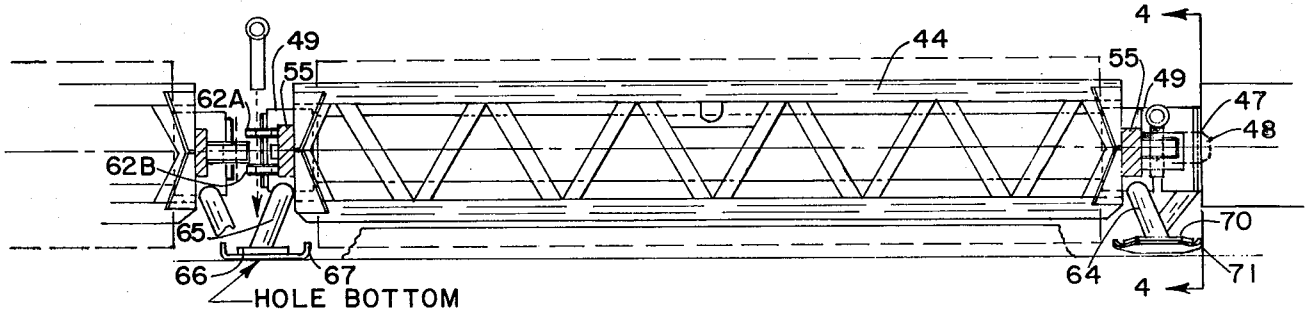
FIG. 3 is a side view of the unitized augering pair taken through the lines 3—3 of FIG. 2.
Figure 2:
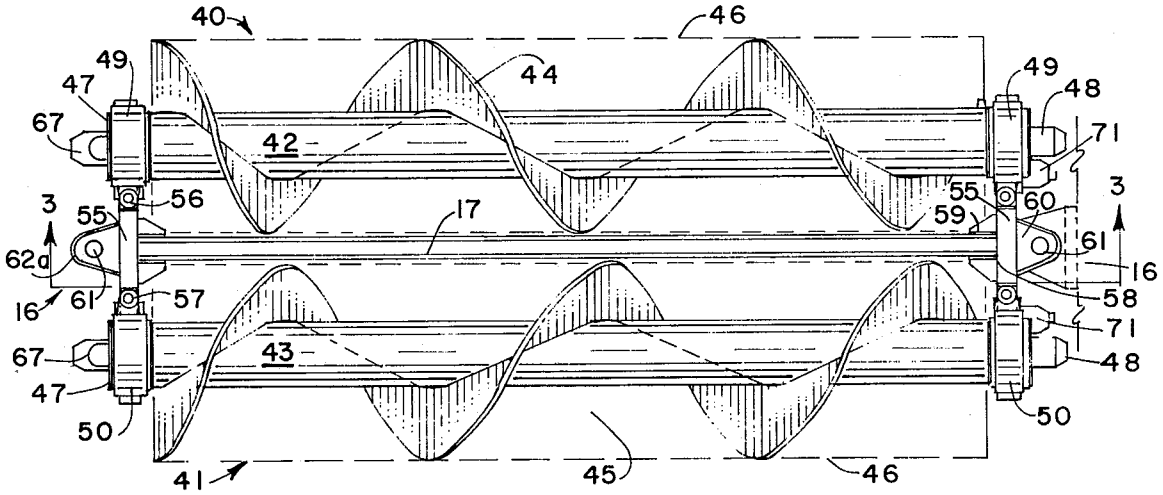
FIG. 2 is a top view of a unitized augering pair illustrating short shoes or skids which are mounted to the bearings.
Figure 4:
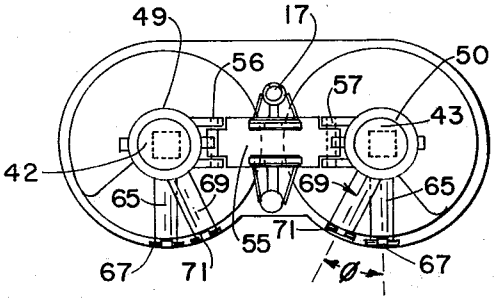
FIG. 4 is an end view of the pair shown in FIG. 3.

Referring to FIGS. 2, 3, and 4, a pair of augers are unitized in the following manner. Augers 40 and 41 have a pair of shafts 42 and 42, respectively. Shaft 42 has a flight 44 attached to it, and shaft 43 has a similar flight 45 thereto. Each flight will generate a surface illustrated by dotted lines 46. Shafts 42 and 43 each have a female coupling 47 and a male coupling 48. Both couplings 47 and 48 are square in shape so that rotational forces can be delivered to each of the shafts, causing them to turn. Around shafts 42 and 43 are mounted bearings 49 and 50, respectively, at each end between couplings 47 and 48, and flight 44 for example. On shaft 42, and between couplings 47 and 48 and flight 45 on shaft 43, a transverse spacing member 55 is attached through pivots 56 and 57 to the housing of bearings 49 and 50, respectively. Transverse spacing member 55 is attached in exactly the same manner at the opposite end of shafts 42 and 43.

Longitudinal support member 17 is rigidly attached to spacer member 55 at 58 by use of plate 59 and welding or any other well-known or usual means.

A clevis-type coupling is utilized to couple one augering pair 15 to a second augering pair 15. Such a clevis-type coupling 16 is a male portion 60 with a vertical opening 61 adapted to receive a pin therethrough. The mating portion is formed by an upper piece 62*a* and a lower piece 62*b.* Pieces 62*a* and 62*b* have a corresponding opening 61 for receiving the pin.

Attached to bearings 49 and 50 at the end containing the female coupling are tubular support are members 69, each of which is attached to a plate 70 and to a skid 71. Referring in particular to FIG. 4, it is noted that the axis of tubular support member 65 is at right angles to support member 55. However, the axis of tubular support member 69 is at an angle $\theta$ with respect to the axis of tubular support member 65. This axial displacement permits the skid 67 and 71 to lie side-by-side as illustrated in FIG. 3 so that the unit can be assembled without interference of the skid members since both skid members are designed to lie directly under bearings 49 when they are mated. Plate 65 is releasably secured to skid 67 by any usual means, such as screws. The releasability of plate 66 permits replacement of skid 67 and also permits the insertion of shim stock between plate 66 and skid 67 to account for the wear on plate 66 as it is used during the removal operation. Skid 71 also is releasably secured to plate 70 for the same purposes as set forth with respect to skid 67.

Referring to FIGS. 5 through 9, modified forms of the skid arrangement shown in FIGS. 2, 3, and 4 are illustrated.

Figure 7:
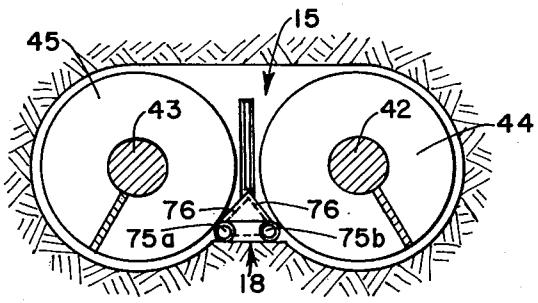
FIG. 7 is an end view of the unitized augering pair shown in FIG. 5 and including the positioning of the unitized pair of FIG. 5 in a hole being formed in the earth to shown the position of the skid with respect to the cusp.
Figure 5:
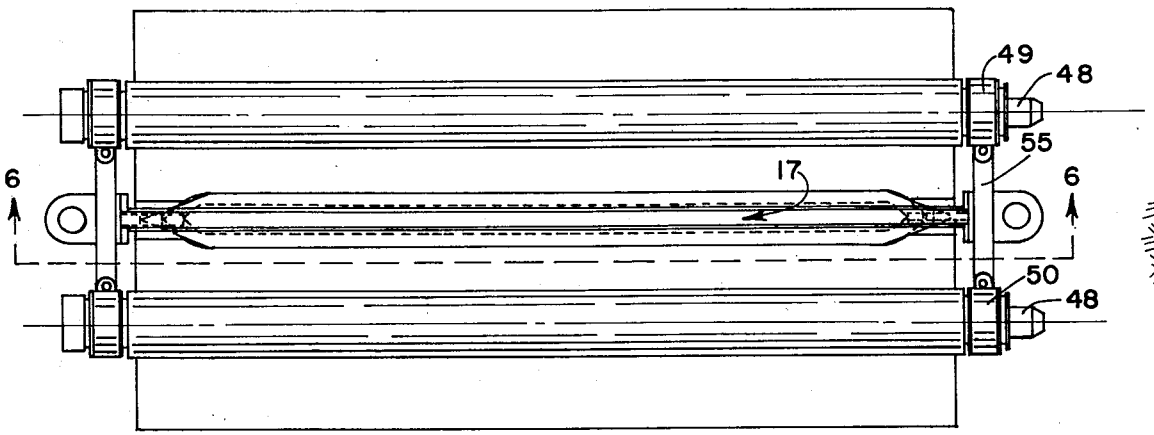
FIG. 5 is a top view of a unitized augering pair illustrating an elongated skid attached to the longitudinal member.
Figure 6:
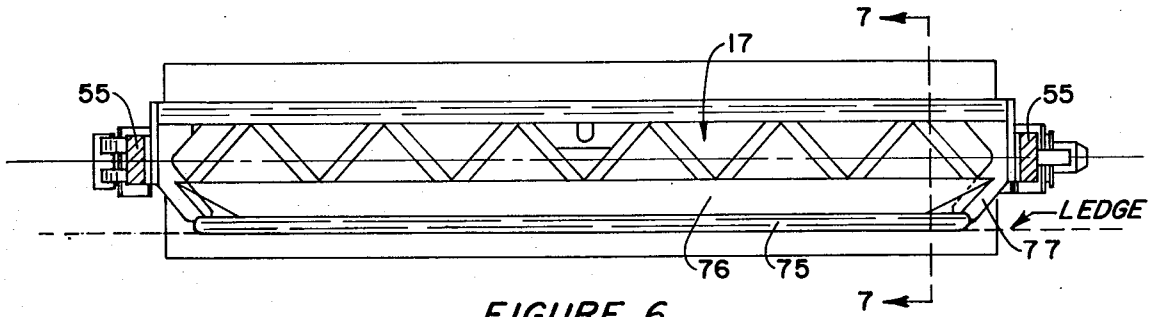
FIG. 6 is a side view of the unitized augering pair taken through the lines 6—6 of FIG. 5.

Referring to FIGS. 5, 6, and 7, a longitudinal skid 75 comprises a tubular member which is attached through plates 76 and tubular member 77 to longitudinal member 17. Skid 76 will have member 77 placed at an angle to prevent buildup of material under the skid during operations. In the embodiment illustrated, particularly referring to FIG. 7, two skids 75*a* and 75*b* are illustrated in order to provide better support for the twin augers on top of the ledge or cusp 78. Skids 75*a* and 75*b* provide horizontal stability to the auger assembly 15, that is, with two support members, the auger assembly will tend to remain horizontally stable and not rock so that flights 44 aor 45 will drag on the bottom of the hole being bored.

Figure 9:
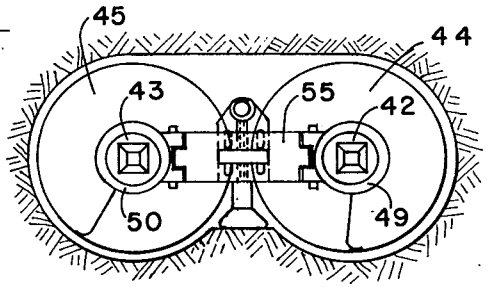
FIG. 9 is an end view of the apparatus shown in FIG. 8 and illustrating the operation of the skid arrangement in a pair of bored holes.
Figure 8:
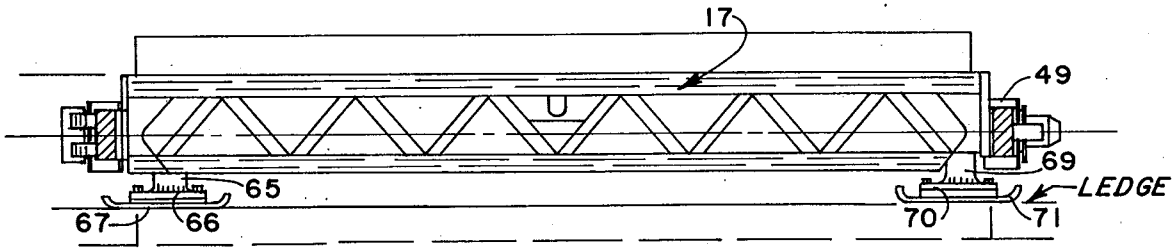
FIG. 8 is a side view of the unitized augering pair of FIG. 5 having a modified form of skids.

FIGS. 8 and 9 illustrate an additional embodiment where a short skid or short shoe is attached in the manner illustrated in FIGS. 2, 3, and 4; however, instead of the attachment being made at the bearing, the attachment is made on longitudinal support member 17. Referring to FIGS. 8 and 9, the tubular support member 69 is attached through a plate 70 to a short skid 71 at bearing end 49, and tubular member 65 is attached to plate 66 and subsequently to skid 67. Both tubular member 65 and 69 are attached to longitudinal support member 17. The plates 70 and 66 provide an attachment means for tubular members 69 and 65, respectively, and also provide a means for replacing skids 71 and 67 when they become too severely worn and also permit the insertion to shim stock to provide a means of compensating for wear of the skids during normal use.

OPERATION

Figure 10:
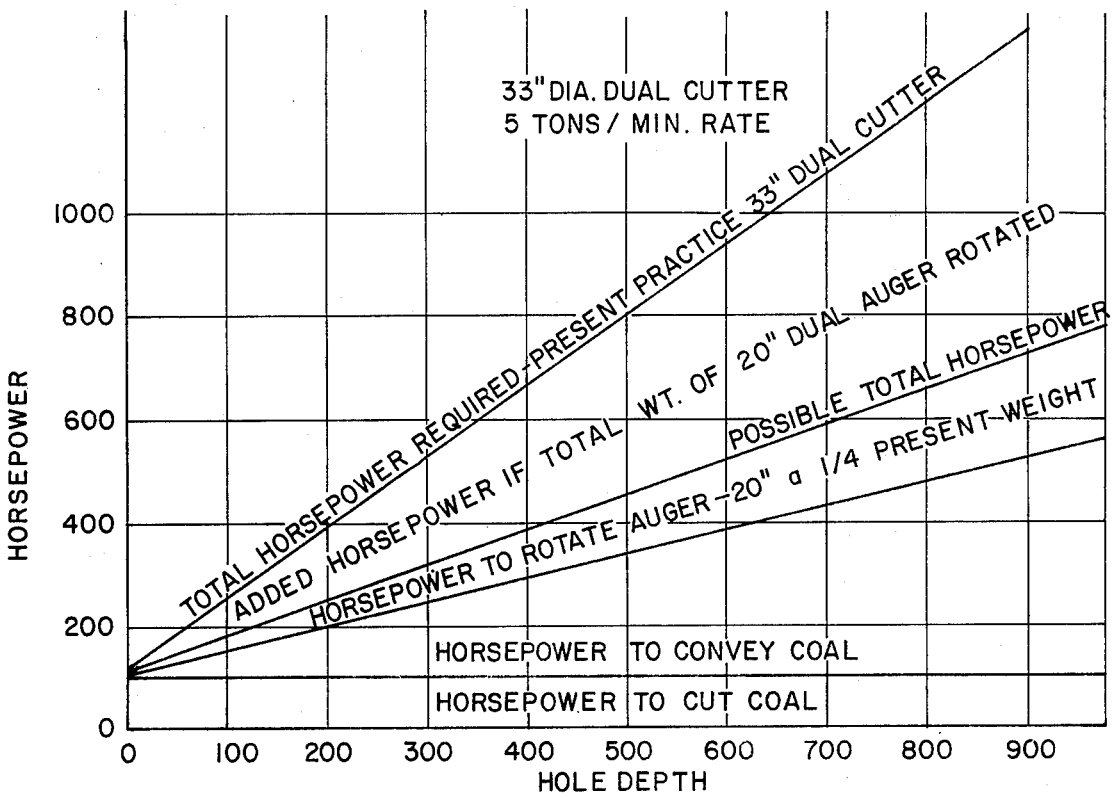
FIG. 10 is a graph showing the reduction in horespower of a 33-inch diameter dual cutter producing 5 tons of coal per minute.
Figure 11:
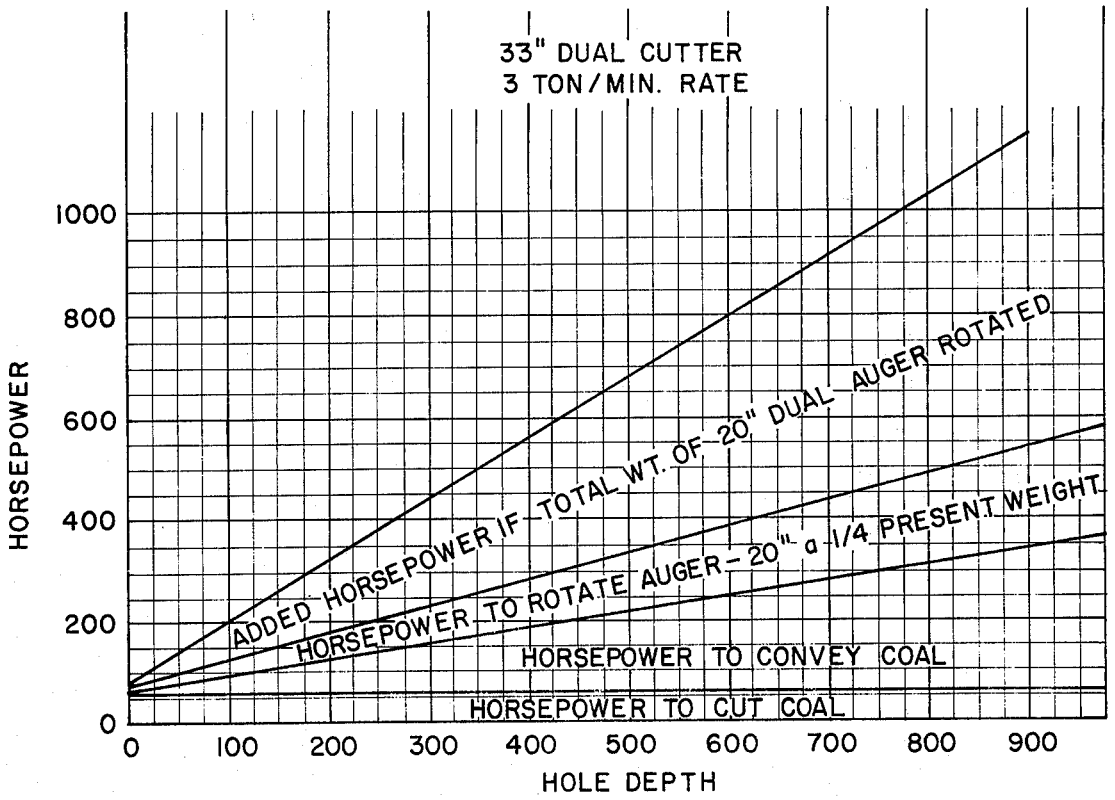
FIG. 11 is a graph illustrating the reduction in horespower of a 33-inch dual cutter producing 3 tons per minute rate when skids of the type of this invention are utilized.

The device illustrated in FIGS. 1 through 9 function as follows. The skid arrangement, either the longitudinal skids illustrated in FIGS. 6, 7, and 8 or the short skid arrangement illustrated in FIGS. 2, 3, and 4 or the modified short skid arrangement shown in FIGS. 8 and 9, basically supports the auger assemblies off the bottom of the hole being bored into the view. By supporting the augers off the bottom of the hole, the horsepower required to rotate shafts 42 and 43 is substantially reduced. An example of the reduction in horsepower is illustrated in FIGS. 10 and 11. FIGS. 10 and 11 each represent different sized auger cutting heads. The bottom line represents the horsepower to cut the coal. The next line represents the horsepower to convey the coal out of the hole. The top line represents the total horsepower for the augers using reduced diameter auger pairs as the depth of the hole increases (i.e. 20-inch diameter). The next to the top line represents the reduction in horsepower to the augering system if the conveyor auger pairs are supported in the manner illustrated in FIGS. 1–9. Viewing FIG. 10, for example, a 33-inch diameter dual auger which is removing 5 tons per minute from the hole being bored will utilize at a 500-foot foot depth approximately 800 horsepower. However, with the support system illustrated in this invention, the horsepower will be closer to 275 horsepower. Looking at FIG. 11 in the 33-inch auger removing 3 tons per minute at 500-foot depth, the amount of horsepower being utilized is approximately 675 horsepower. However, with the augers being supported in the manner illustrated in this invention, the horsepower will be close to 350 horsepower, which is a substantial reduction in horsepower. The advantage of reducing the horsepower in addition to reducing the total expenditure of energy to remove a fixed tonnage of coal is the maximum depth that a machine having a maximum horsepower can operat. For example, a 600-horsepower machine with 33-inch augers and removing 5 tons of coal per minute could drill a maximum of 350 feet. This very same equipment operating with the auger supporting system of this invention could drill approximately 700 feet before maximum horsepower utilization was reached. The difference between 350 feet and 700 feet represents a considerable savings in time required to move the equipment, the time required to cut additional trenches down to the coal seam, and a multitude of other problems that arise in drilling short auger holes. If for example 3 tons per minute were being removed rather than 5 and a 600-horsepower machine were available, a 425-foot hole could be realized without the support system illustrated in the invention. However, over 1,000 feet could be drilled if the skid arrangement illustrated in this invention were utilized. The difference between 425 feet and 1,000 feet means that in many instances where the mountain is less than 2,000 feet wide where the coal seam is outcropping on the surface, only one ledge on each side of the mountain need be made rather than a swath cut through the mountain. Basically, this will permit removal of most of the coal from a coal seam rather than a small amount of coal, since environmental conditions at the present time will not permit the cutting of an extremely deep swath in the mountainside to remove coal. This invention then basically permits an efficient augering system to be realized.

The preferred system (shown in FIGS. 3 and 4) provides a support system from the bearings down to the bottom of the coal being augered. In this system, very accurate support of the augers is realized. Furthermore, staggering the mountings 65 and 69, as illustrated in FIG. 4, by an amount $\theta$ provides for a system of allowing the short skids 67 and 71 to be positioned side-by-side when the auger assemblies are mated. The mounting of the skids in the manner illustrated in FIGS. 2, 3, and 4 also provides ease in stacking the assemblies one on top of the other or side-by-side when the assemblies are out of the machine and out of the coal seam in a storage location. The advantage of the mounting of the short skids in FIGS. 2, 3, 4, 8, and 9 is that when the skids wear, shim stock can be placed between plate 70 and skid 71, thus carefully positioning the auger in the center of the hole being cut. If for example skid 71 should wear by an appreciable amount, then auger flights 44 and 45 for example would rub against the bottom since with the amount of weight involved, they will tend to sag in the center. As the skids 71 or 67 gradually wear, either shim stock can be placed between plate 70 and skid 71 to account for the wear or new skids 71 and 67 can be attached to plates 70 and 66, respectively. When a skid arrangement illustrated in FIGS. 5 through 7 is used, as skids 75 wear, new skids will have to be welded to support plates 76 and 77.

CONCLUSIONS

This invention discloses a means for supporting a unitized auger system so that the flight will be positioned away from the bottom of the hole being cut. As thus positioned, the horsepower will be drastically reduced, thus permiting the augering system to bore a hole in the earth over twice as long as the hole could be bored without the support system illustrated in this invention. It is obvious that other type support structures can be used along the lines suggested in this invention without departing from the spirit and scope of the invention as disclosed in the claims and specification.

What we claim is:

1. In an auger mining system which forms an opening comprising a pair of axially aligned cylindrical holes in the earth, said opening having a bottom, said system having a pair of side-by-side auger conveyors, each auger having a shaft and a flight around said shaft, which shafts are journaled through bearings at each end to a spacing member and wherein said spacing members are rigidly tied to each other by a longitudinal member having an underside and a supporting apparatus comprising an elongated skid means attached to the underside of said longitudinal member of said suger pair and extending to the bottom of said opening.

2. In a pair of side-by-side auger conveyors for conveying material from a longitudinal opening having a bottom, each auger having a shaft journaled at each end to a spacer member, a longitudinal member rigidly attached to said spacer members and extending longitudinally between pairs of augers and flights along the length of said shaft, a support means attached to said longitudinal member at each end thereof and extending toward the bottom of said longitudinal opening by an amount to position said flights away from the bottom of said longitudinal opening.

3. In an apparatus as defined in claim 2 wherein said longitudinal opening includes a pair of substantially cylindrical side-by-side horizontal holes having a cusp between said holes forming the bottom of said opening and wherein said support means comprises a plurality of aligned skid means riding on said cusp and a support member attached between each said skid means and said longitudinal member.

4. An apparatus as defined in claim 3 wherein said skid means comprises a pair of short shoes attached under said spacer means and riding on top of said cusp.

5. In a pair of side-by-side auger conveyors for conveying material from a longitudinal opening having a bottom, said longitudinal opening including a pair of substantially cylindrical side-by-side horizontal holes having a cusp between said holes and forming the bottom of said opening, each said auger having a shaft journaled at each end to a spacer member, a longitudinal member rigidly attached to said spacer members and between pairs of augers and flights along the length of said shaft, a support means attached to said longitudinal member and extending toward the bottom of said longitudinal opening by an amount to position said flights away from the bottom of said longitudinal opening, said support means including a tubular member extending the length of said longitudinal member in supporting contact with said cusp.

* * * * *